United States Patent [19]

Mahon

[11] 4,001,529

[45] Jan. 4, 1977

[54] PERCENTAGE TIMER

[75] Inventor: Joseph J. Mahon, Libertyville, Ill.

[73] Assignee: The Singer Company, New York, N.Y.

[22] Filed: Apr. 11, 1975

[21] Appl. No.: 567,303

[52] U.S. Cl. ..... 200/39 R

[51] Int. Cl.[2] ..... H01H 7/08; H01H 43/10

[58] Field of Search ... 200/153 L, 153 LA, 153 LB, 200/30 R, 31 R, 33–39; 74/54, 568 R, 568 T, 569

[56] References Cited

UNITED STATES PATENTS

| | | | |
|---|---|---|---|
| 2,706,224 | 4/1955 | White | 200/39 R |
| 2,920,153 | 1/1960 | Horstmann | 200/153 L X |
| 3,599,006 | 8/1971 | Harris | 200/39 R X |
| 3,699,821 | 10/1972 | Harris | 200/39 R X |
| 3,739,109 | 6/1973 | Ege | 200/153 LB X |
| 3,965,312 | 6/1976 | Mahon | 200/39 R |

*Primary Examiner*—James R. Scott
*Attorney, Agent, or Firm*—Michael, Best & Friedrich

[57] ABSTRACT

The follower tip of the switch operating bell-crank lever can ride on the large diameter of the axially movable, rotatably driven cam or on axial movement of the cam can drop onto the smaller diameter of the cam to close one switch and, upon further axial movement, the follower can move further in to a pseudo inner diameter to close a second switch. The lever acts to prevent return axial movement of the cam until the cam notch is aligned with the follower and the follower no longer interferes with axial movement.

10 Claims, 11 Drawing Figures

Fig. 1
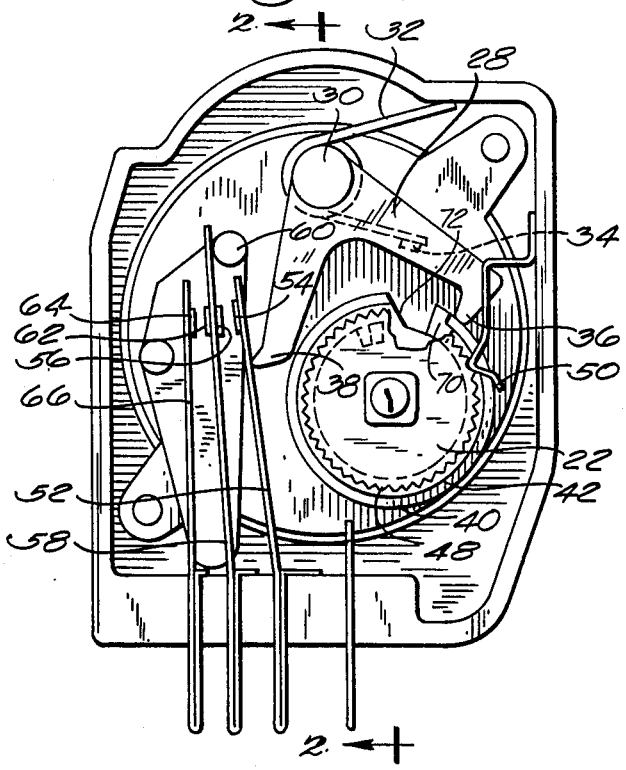
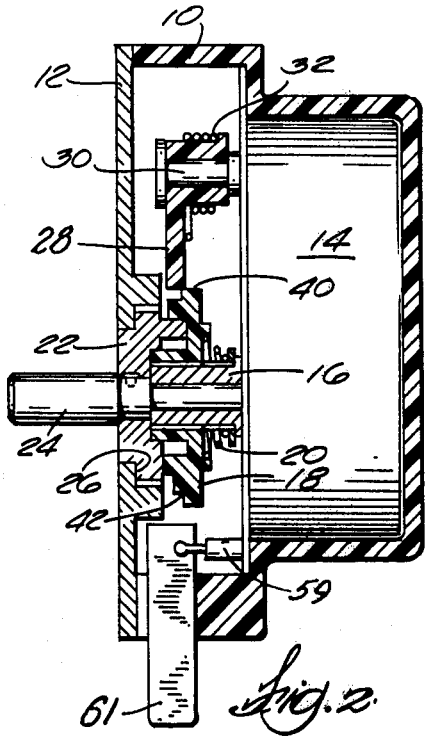
Fig. 2
Fig. 3
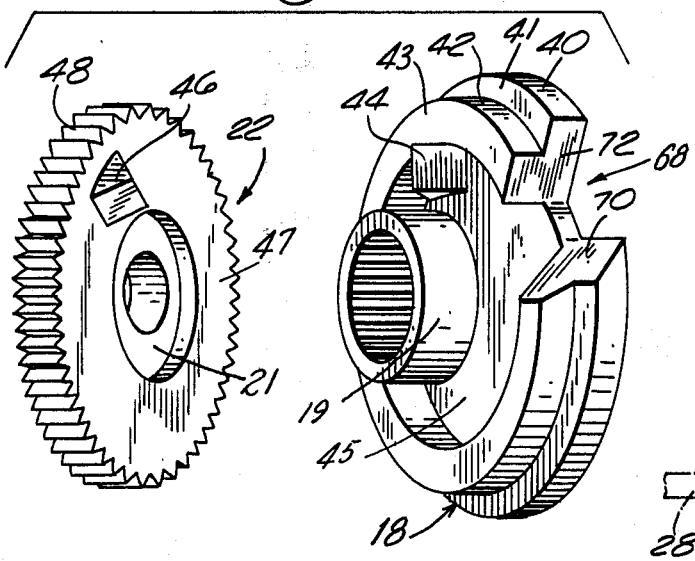
Fig. 4
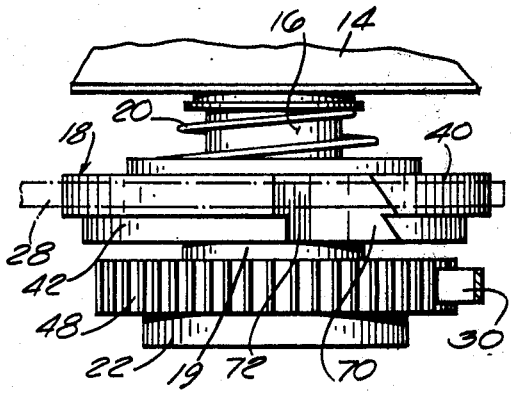

PERCENTAGE TIMER

BACKGROUND OF THE INVENTION

This invention relates to an adjustable percentage timer. There are situations where adjustment of a percentage timer by an unsophisticated user is desirable. In response to such needs the industry has provided rather complex and costly solutions based on old basic structures rather than taking a fresh approach. And the prior art frequently restricted the range of adjustment in order to retain old basic structures.

SUMMARY OF THE INVENTION

The object of this invention is to provide a simple, full range percentage timer which is easily adjusted and can be produced at low cost. The structure described in the Abstract represents a great reduction in the number of parts while attaining the desired performance goals. Both rotary and axial motion of the cam are utilized and an adjustable fixed (non-rotary) cam determines the timing of switch closure and, hence, the percentage of time the switch is closed. Provision can be made for 100% "ON" time and for 0% "ON" time.

DESCRIPTION OF THE DRAWINGS

FIG. 1 is a plan view of the timer with the cover removed.

FIG. 2 is a section taken through the timer on the meandering line 2—2 in FIG. 1.

FIG. 3 is an exploded perspective of the rotating and adjustable cams.

FIG. 4 is an enlarged detail of the cams in assembled position.

DESCRIPTION OF THE PREFERRED EMBODIMENT

Figure 5:
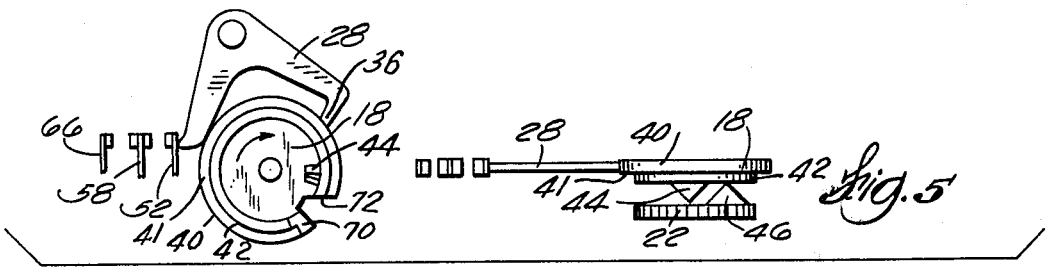
FIG. 5 is essentially two companion figures with the left-hand view showing the position of the lever on the rotating cam and the positions of the switch contacts while the right view illustrates the parts from above to illustrate the relative position of the lever, the rotating cam, and the fixed cam.

The timer is housed in housing 10 provided with a cover 12. The motor details are not shown but the motor is located in the space 14 and drives hollow shaft 16. The cam member 18 is splined on shaft 16 and is biased to the left (forward) in FIG. 2 by spring 20 with the limit of movement to the left being determined by engagement of the collar 19 with the recess 21 in the relatively fixed but adjustable cam 22 fixed on the stepped shaft 24 which is, in effect, journaled by shaft 16 and by engagement of the cam 22 with the cover 12.

The adjustable cam 22 has a shoulder portion 26 which engages the cover and prevents the spring 20 acting on cam 18 from pushing the cam 22 out of the cover.

A lever 28 in the form of a bell crank is pivotally mounted on post 30. One end of spring 32 bears against the housing and the spring is coiled around post 30 with the other end of the spring bearing against boss 34 on the lever to bias the lever in a clockwise direction around its pivot post. In FIG. 1 the right end of the lever functions as a cam follower 36 while the left end of the lever comprises the switch actuating portion 38. The follower can ride on the periphery of the large diameter portion 40 of cam 18 or can ride on the intermediate or smaller size diameter portion 42 of the cam while surface 41 prevents movement of the cam to the left (FIG. 2) under influence of spring 20. When the cam is properly actuated, the lever 28 can move further inwardly of the cam to an extent determined by the switches closing and "going solid" to limit lever movement.

Cam 18 is provided with a face cam 44 projecting from surface 45 which is engageable with face cam 46 projecting from surface 47 on the relatively fixed but adjustable cam 22. Cam 22 is fixed on shaft 24 and is provided with peripheral teeth 48 which are engaged by the bent spring 50 secured to the housing to retain the cam 22 in the position to which it is set by the user by turning shaft 24. Referring now to FIG. 5, it will be seen that with the follower 36 riding on the outer diameter of cam 18 all the switch contacts are open, i.e. the blade 52 carrying contact 54 is not in engagement with contact 56 on blade 58. The blade 56 is itself biased against post 60 and thus contact 62 on blade 58 is kept away from contact 64 on blade 66. One motor lead 59 comes from terminal 61 while the other lead (not shown) connects with blade 52. In FIGS. 5 through 9 the cam 18, as viewed from the top, is traveling in the direction of the arrow.

Figure 6:
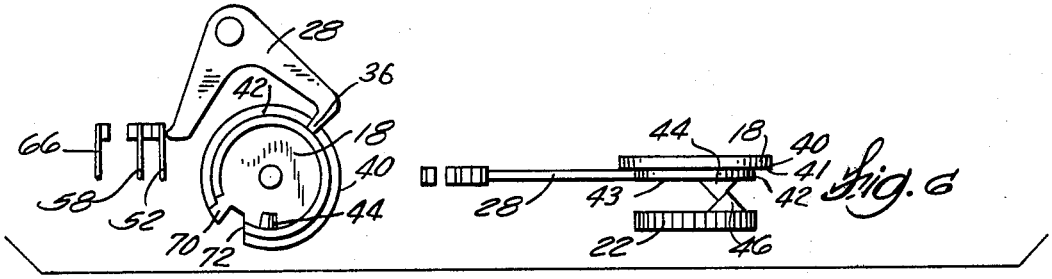
FIG. 6 is comparable to FIG. 5 but shows the positions of the parts when the first pair of switch contacts has been closed.
Figure 7:
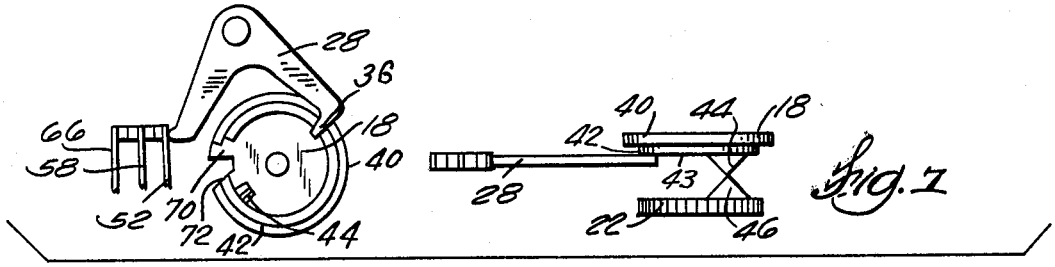
FIG. 7 shows the position of the parts when both pairs of switch contacts are closed.

When the face cam 44 on rotating cam 18 engages the fixed face cam 46 on the adjustable cam 22 as shown in FIG. 6, cam 18 is forced to move axially on its splined connection against the bias of spring 20 to the position illustrated in FIG. 6. At this point the follower 36 drops to the smaller diameter 42 and this then permits the actuator 38 of the lever 28 to close contact 54 on contact 56. Return motion of cam 18 is prevented by engagement of lever 28 with surface 41. As rotation of cam 18 continues, the cam 18 is forced still further in the axial direction until the lever can drop off of diameter 42 whereupon the second set of contacts 62,64 are closed (FIG. 7). Lever 28 now engages surface 43 to prevent return of the cam 18. Thus the contacts are made to close in sequence. It is obvious that by providing a stepped configuration to either face cam 46 or face cam 44 the sequential closing of the switches can be timed differently. In either of the positions shown in FIG. 6 or in FIG. 7 the cam 18 is prevented from moving forward under the influence of biasing spring 20 by the interference caused by the follower 36 engaging the surfaces 41 or 43, respectively.

Figure 8:
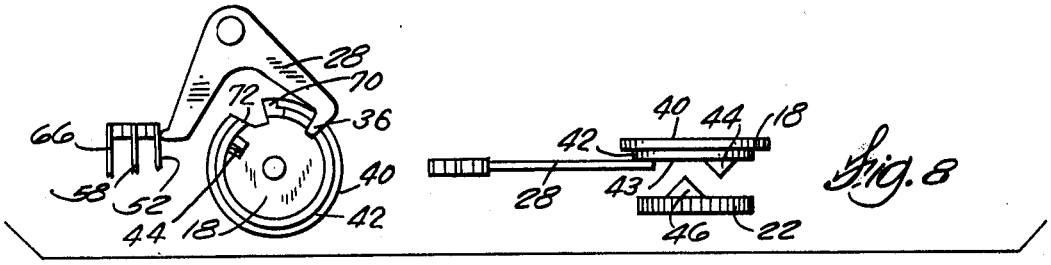
FIG. 8 shows the position of the parts with all the switch contacts closed in the "ON" mode.
Figure 9:
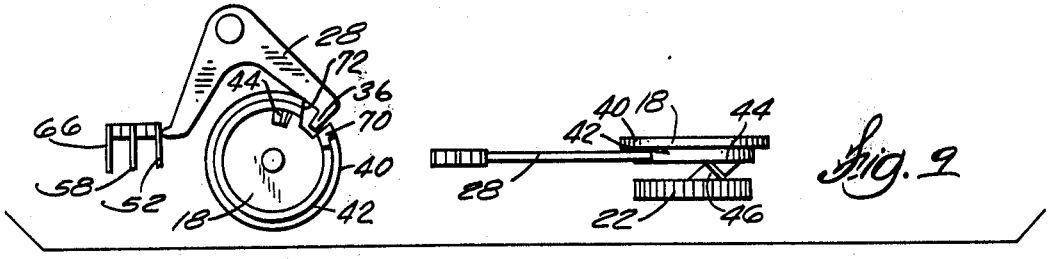
FIG. 9 shows the position of the parts during resetting of the rotating cam in preparation for opening the switches.
Figure 10:
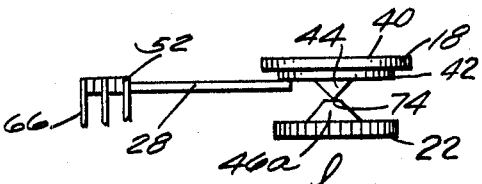
FIG. 10 shows the manner in which provision can be made for continuous "ON" operation.
Figure 11:
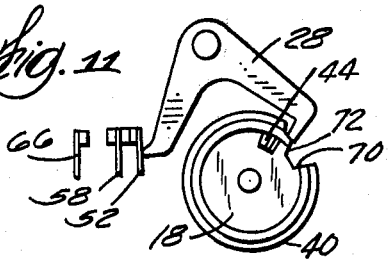
FIG. 11 shows the modified structure of the rotating cam to achieve programmed sequential opening of the switches.

The switches will remain closed as indicated in FIG. 8 until such time as the notch 68 in the perimeter of cam 18 is aligned with the follower 36 of lever 28, in which position the follower is no longer operative to prevent axial movement of the cam 18 under influence of spring 20. Thus as the cam rotation continues and the notch becomes aligned with the follower, the cam can move forward putting the follower into the notch; or, put another way, causing the notch to straddle the follower. To keep this movement quiet the entry into the notch is beveled at 70 (see FIG. 3) which will cause the cam to move forward quietly. This condition is indicated in FIG. 9 and, considering FIG. 9, it will now be obvious that further rotation of the cam 18 will cause the sloping portion 72 of the notch to push the follower 36 up to the outer (large) diameter 40 of the cam 18, thus opening the switches. If desired, the sloping portion 72 can be stepped as indicated in FIG. 11 to achieve a pronounced sequential opening of the switches. It will also be apparent that by providing the face cam 46*a* with a flat 74 as illustrated in FIG. 10, the follower can be prevented from entering the notch, or, put another way, cam 46*a* can be shaped so that if aligned with the face cam 44 at the correct position the cam 18 can be prevented from moving forward when the notch becomes aligned with the follower, thus preventing opening of the switches. This can give 100% "ON" time to the percentage timer.

When shaft 24 is rotated it, in effect, rotates the position of face cam 46. The position of face cam 46 obviously determines when the switches will close. The opening position of the switches is always determined by the notch. Thus by varying the relative position of the face cam 46 the percentage of "ON" time provided by the timer can be adjusted over the full range. The adjusted position is retained by the spring 50 engaging the peripheral teeth 48 on the cam 22.

If a very small percentage "ON" time is to be provided, the trailing surfaces of the face cams 44,46 must be made steep so that the cam 18 can be moved axially to actuate the switches and then by reason of the steep trailing side the follower can be allowed to immediately enter the notch and then open the switches. An extremely wide range of "ON" time can be provided by this design. If 0% is desired, it is a simple matter to provide a projecting arm on the cam 22 which when correctly positioned would interfere with movement of lever 28 and thus cancel out actuation of the lever by the cam 18. Details such as this are considered obvious when the basic design is considered.

It will be obvious that if only one set of contacts need be closed, then the cam member can have but the one large diameter portion and the face cams would operate to move the cam from under the lever permitting the lever to drop to whatever position it wanted in order to close the one set of switches.

From this it follows that the simplest form is a single switch actuated by a simple disc cam provided with the notch and with the face cam.

I claim:

1. A timer including a motor driving a shaft, a disc cam mounted on and driven by said shaft and being axially movable relative to the shaft, means biasing the cam to a first position, a lever including a cam follower biased into engagement with the perimeter of the cam when the cam is in said first position, means for moving the cam axially on said shaft to a second position in which position the cam moves out from under said follower and the lever moves inwardly of the cam along a face of the cam and engagement of the follower with said face prevents return of the cam to said first position under influence of the cam biasing means, a switch actuated by said lever when the follower moves inwardly, and means for returning the follower to the perimeter of said cam and the cam to said first position.

2. A timer according to claim 1 in which said returning means comprises, a notch in the cam which when rotated into alignment with the follower allows the cam biasing means to move the cam to said first position, said cam notch being contoured to act on the follower to lift the follower to the cam perimeter as cam rotation is continued.

3. A timer according to claim 2 in which the means for moving said cam axially comprises cam means.

4. A timer according to claim 3 in which the rotational position of the cam at which the cam means is effective to move the cam axially is adjustable to thereby adjust the degrees of cam rotation during which the switch is actuated.

5. A timer according to claim 4 in which the cam means includes an adjustably fixed axially active cam member and the disc cam is provided with an axially active cam member whereby operative engagement of said members causes axial movement of the cam.

6. A timer according to claim 2 including a second switch actuated by said lever.

7. A timer according to claim 6 in which said disc cam has a larger diameter disc and a smaller diameter disc and said lever actuates the first switch when the disc cam is moved axially to said second position and actuates the second switch when the disc cam is moved further axially to a third position.

8. A timer according to claim 7 including a face cam on the disc cam and an adjustably mounted relatively fixed face cam member, engagement of the face cam with the face cam member being operative to move the disc cam axially.

9. A timer according to claim 2 including means selectively operative to prevent axial movement of the disc cam from said second to said first position.

10. A timer including a motor driving a shaft, a disc cam mounted on and driven by said shaft and being axially movable relative to the shaft, cam follower means biased into engagement with the disc cam, a switch actuated by the cam follower means, means for moving the disc cam axially from a first to a second position whereby the cam follower means is not controlled by the disc cam and moves inwardly relative to the disc cam to actuate said switch and to act against the face of the cam disc to prevent movement of the cam disc to said first position, means for moving the disc cam axially from said second to said first position whereby the cam follower means is restored to control by the disc cam.

* * * * *